US006450539B1

(12) United States Patent
Bilbie et al.

(10) Patent No.: US 6,450,539 B1
(45) Date of Patent: Sep. 17, 2002

(54) REWRITABLE ERASABLE LABELS

(76) Inventors: Clive James Bilbie, 298 Oriental Parade, Wellington (NZ); Roy Beverly Tipper, 45 The Terrace, Wellington (NZ)

( * ) Notice: Subject to any disclaimer, the term of this patent is extended or adjusted under 35 U.S.C. 154(b) by 0 days.

(21) Appl. No.: 08/776,621

(22) PCT Filed: May 31, 1995

(86) PCT No.: PCT/NZ95/00046

§ 371 (c)(1),
(2), (4) Date: Mar. 24, 1997

(87) PCT Pub. No.: WO95/33251

PCT Pub. Date: Dec. 7, 1995

(30) Foreign Application Priority Data

May 31, 1994 (NZ) ..... 260643

(51) Int. Cl.[7] ..... B42D 15/00
(52) U.S. Cl. ..... 283/81; 434/410
(58) Field of Search ..... 283/81; 434/410

(56) References Cited

U.S. PATENT DOCUMENTS

| | | | | | |
|---|---|---|---|---|---|
| 2,697,884 | A | * | 12/1954 | Dechart | 434/201 |
| 4,589,685 | A | * | 5/1986 | Lazar | 283/81 |
| 4,763,929 | A | * | 8/1988 | Weil | 283/81 |
| 5,855,083 | A | * | 1/1999 | Bilbie et al. | 434/410 |
| 5,860,235 | A | * | 1/1999 | Bilbie et al. | 434/410 |

FOREIGN PATENT DOCUMENTS

| | | | | |
|---|---|---|---|---|
| EP | 387 138 | * | 9/1990 | 283/81 |
| FR | 91 07711 | * | 12/1992 | 283/81 |
| WO | WO 89/12556 | * | 12/1989 | 283/81 |
| WO | WO 92/22434 | | 12/1992 | |
| WO | WO 92/22901 | * | 12/1992 | 283/81 |
| WO | WO 93/17876 | * | 9/1993 | 283/81 |
| WO | WO 94/14148 | | 6/1994 | |
| WO | WO 94/24654 | | 10/1994 | |
| WO | WO 95/11502 | | 4/1995 | |

* cited by examiner

*Primary Examiner*—David P. Bryant
(74) *Attorney, Agent, or Firm*—Gray, Cary, Ware & Freidenrich

(57) ABSTRACT

An erasable product such as an erasable and rewritable label or an erasable sign comprises a base layer (2) and a transparent or translucent upper sheet (3) over the base layer which provides a smooth and wrinkle-free top surface to the product. The upper sheet and base layer are releasably adhesive together under pressure applied manually on the upper sheet such as writing pressure with a blunt stylus, to cause the upper sheet and the base layer to adhere in the localized region of pressure to display the writing in the case of a label. The upper sheet can be, moved sufficiently to separate it from the base layer when a user's finger or thumb is wiped across the top surface of the upper sheet. The upper sheet also extends over a wipe-start region (2*a*) where the upper sheet and the base layer are not adhesive together, over which wipe-start region a user's finger or thumb may be placed from which to begin said movement to separate the upper sheet from the base layer. The upper sheet comprises a discontinuity (3*a*) across the upper sheet (across the direction of finger movement) within the wipe-start region (2*a*) or between the wipe-start region and the balance of the upper sheet which extends smoothly over the base layer, which assists in erasing the erasable product.

10 Claims, 5 Drawing Sheets

REWRITABLE ERASABLE LABELS

FIELD OF INVENTION

The invention comprises an erasable product such as an erasable label, a repositionable erasable write-on marker, an erasable sign or similar.

BACKGROUND

Our PCT patent application GB92/01057 (WO92/22434) discloses an erasable and rewritable label comprising a base layer of contrasting colour and a transparent or translucent upper sheet which can be adhered to the base layer under writing pressure and which label can be erased by wiping a user's finger or thumb over the top surface of the upper sheet. The invention comprises a unique rewritable label which is erasable for reuse by "finger wipe erasure".

Our PCT patent application NZ93/00125 (WO94/14148) discloses an improved form of such an erasable product, incorporating a "wipe-start" region where the upper sheet and the base layer are not adhesive together, over which wipe-start region a user's fingers or thumb is placed to begin the finger wipe erasure movement.

Our PCT parent application NZ94/00031 (WO94/24654) discloses an erasable sign comprising a base layer and a transparent or translucent upper sheet; in some cases the upper sheet and base layer may be caused to adhere together by pressure on the upper sheet to display the icon or indicia and the upper sheet may be released from the base layer by finger wipe erasure to erase the icon or indicia, and in other cases the icon or indicia is displayed when the upper sheet is released from the base layer by finger wipe erasure and is erased when the upper sheet is pressed to adhere to the base layer.

SUMMARY OF INVENTION

It is an object of the invention to provide an improved form of erasable product.

In broad terms the invention comprises an erasable product comprising a backing sheet, a base layer on the backing sheet, and an upper sheet extending over the base layer and fixed in relation to the base layer, which upper sheet and base layer are sufficiently releasably adhesive together under pressure applied manually on the upper sheet to cause the upper sheet and the base layer to adhere in the localised region of said pressure but to allow the upper sheet to move sufficiently relative to the base layer to separate the upper sheet from the base layer when auser's finger or thumb is wiped across the top surface of the upper sheet, the upper sheet also extending over a "wipe-start" region adjacent the base layer in which wipe-start region the upper sheet and the base layer are not adhesive together, over which wipe-start region a user's finger or thumb may be placed to begin said movement to separate the upper sheet from the base layer, the upper sheet also containing a discontinuity in the upper sheet across a substantial portion of the upper sheet (across the definition of said finger movement) within the wipe-start region or between the wipe-start region and the balance of the upper sheet which extends smoothly over the base layer.

The discontinuity in the upper sheet tends to assist in the formation of a wave or wrinkle, when a user's fingers or thumb is wiped across the top surface of the upper sheet from the wipe-start region, which will separate the upper sheet from the base layer, erasing any indicia in the erasable window.

The erasable product may comprise a repositionable erasable product such as a repositionable label or message note or a repositionable write-on marker (like a tape flag) or a repositionable erasable sign, having a restrictable contact adhesive on a part of the rear surface of the product enabling the marker or sign to be stuck to a surface and subsequently removed and repositioned.

The erasable product may comprise an erasable and rewri table label or message note or similar having adhesive on all of the rear surface of the product enabling it to be permanently or semi-permanently stuck to in object or item such as a video cassette, computer disc folder or any other objection or item.

Alternatively again the erasable product may comprise part of or be a novelty or other card or item having no adhesive rear surface.

In erasable products of the invention details are written on the upper sheet of the erasable product for example with a blunt instrument such as a blunt stylus, a pen or pencil (preferably the non-marking end so as not to permanently mark the erasable product) or any hard object. To erase the erasable product a user's finger is wiped under moderate pressure, from the "wipe-start" region across the top sheet over the discontinuity in the upper sheet and then over the written details on the product, which are thereby erased.

In erasable products of the invention the upper sheet is preferably translucent to enhance the contrast between the colour of the base layer and the balance of the upper sheet. The upper sheet may additionally or alternatively be tinted with a different colour relative to the colour of the base layer, so that in the cast of a label for example the label normally appears to have the colour of the upper sheet and when written on the writing appears in the colour of the base layer, or in a colour resulting from the combination of the base layer and upper sheet colour. For example, the base layer may be coloured blue and the upper sheet toned yellow, when pressed or adhered together under localized pressure of writing the writing will appear green in contrast to the balance of the yellow upper sheet. The colours may be luminescent or fluorescent. The upper sheet may also be made luminescent or fluorescent or may be lightly embossed with a pattern or logo for example which may be present as a hologram printed onto the upper sheet.

In another form of the invention the erasable product is an erasable sign. The product comprises a contrasting icon or indicia in or below the base layer which icon or indicia is visible through the upper sheet when pressure is applied manually on the upper sheet for example with a blunt writing instrument to cause the upper sheet and the base layer to adhere, and which is made substantially less visible when a user's finger or thumb is wiped across the top surface of the upper sheet from the wipe-start region across the discontinuity region and then the balance of the top surface of the product to separate the upper sheet from the base layer. The base layer may be formed in the shape of the icon or indicia as a positive image of the icon or indicia, or as a negative image, or the icon or indicia may be printed on a surface beneath the base layer as a positive or negative image and the base layer applied over said surface as a clear or substantially clear coating.

In another form of erasable sign similar to that described above and which is used similarly the base layer may be continuous and a coating to which the upper sheet will nor adhere may be coated over the base layer i.e. the coating is a negative image of the icon or indicia (but could be a positive image). Such a coating may be applied to the underside of the upper sheet instead of to the top of the base layer.

In another form of erasable sign of the invention an icon or indicia is printed on the upper sheet in a colour such that when pressure is applied manually on the upper sheet for example with a blunt writing instrument-to cause the upper sheet and the base layer to adhere the icon or indicia is made substantially less visible, and when a user's finger or thumb is wiped across the top surface of the upper sheet from the wipe-start region across the discontinuity region and then the balance of the top surface of the product to separate the upper sheet from the base layer the icon or indicia becomes visible. The icon or indicia may be printed on the underside or top of the upper sheet, as a positive or negative image.

In all forms of erasable products of the invention the upper sheet and the base layer may be made non-adhesive together in the wipe-start region by not applying material comprising the base layer beneath the upper sheet in the wipe-start region, or by applying a coating which prevents the upper sheet and base layer from adhering together to the under surface of the upper sheet or the top surface of the base layer, or both, in the wipe-start region.

DESCRIPTION OF PREFERRED DRAWINGS

Preferred forms of erasable products of the invention will now be described by way of example and without intending to be limiting as to derail, with reference to the accompanying drawings, wherein.

Figure 1:
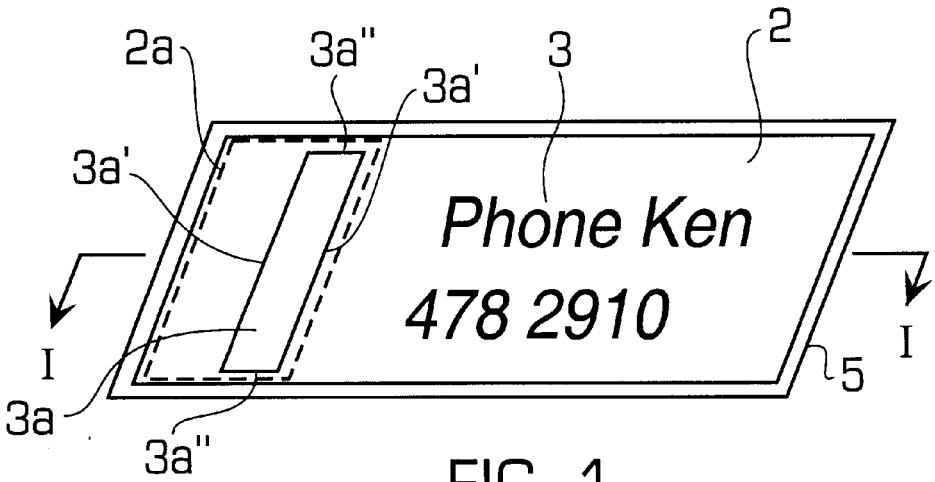
FIG. 1 shows one preferred form of repositionable erasable and rewritable marker.

Referring to the drawings, the erasable product of FIGS. 1 to 4 is a repositionable erasable and rewritable write-on marker which comprises a base layer 2 and in upper sheet 3 extending over the base layer. The base layer 2 comprises a layer of wax or similar synthetic material which will adhere with the upper sheet 3 as indicated previously. The base layer 2 is coated onto a backing sheet 5. The base layer is coloured or appears coloured for example dark blue, or alternatively any other desired colour or combination of colours in different regions.

Suitable materials for forming the base layer include waxes such as paraffin wax, blend, of paraffin wax with other waxes, blends of other waxes, and other substances such as synthetic wax like substances having a waxy consistency, which can be applied as a thin layer and will adhere with the upper layer. Some base layers such as some synthetic wax-like base layers may be coloured by having a dye added, or alternatively the base layer may be made to appear coloured by printing a colour on a substrate and then applying a clear or near clear wax or similar material over the coloured surface to form a coloured base layer.

The base layer may comprise any other suitable material than wax, which will adhere with the upper sheet 3 under localized manual pressure such as pressure of writing in the case of a label but which also allows the base layer and top sheet co be subsequently separated to erase the label.

The backing sheet 5 which may consist of a layer of light card or paper or plastic or other rigid or non-rigid substrate. The backing sheet 5 has a restrictable contact adhesive on a part of its rear surface as indicated at 5*a*, to enable the marker to stick to a surface and subsequently be removed from the surface and repositioned etc.

It is possible that the material of the backing sheet 5 could form the base layer so that the base layer 2 and backing sheet 5 are one and the same.

The upper sheet 3 is preferably translucent and may comprise a translucent plastic tracing paper or the like. A clear plastic film may be given qualities of translucence by etching, texturing or calendaring the film and particularly the bottom surface of the film, for example. This may also assist the upper sheet to adhere with the base layer in use. A clear film may also be made translucent by printing the film with a translucent ink or a layer of a conventional opaque ink which is thin enough to make the film appear translucent. The upper sheet 3 may be printed to define a window in the upper sheet for example through which the written derails of the repositionable marker are visible. Regions of the upper sheet other than such a window may be provided for carrying permanently printed media such as advertising media.

Most preferred for forming the upper sheet are polyester films or similar materials preferably having a glossy or substantially glossy surface. Preferably the upper sheet is up to 100 microns and most preferably in the range 35 to 65 microns in thicknesses.

Figure 2:
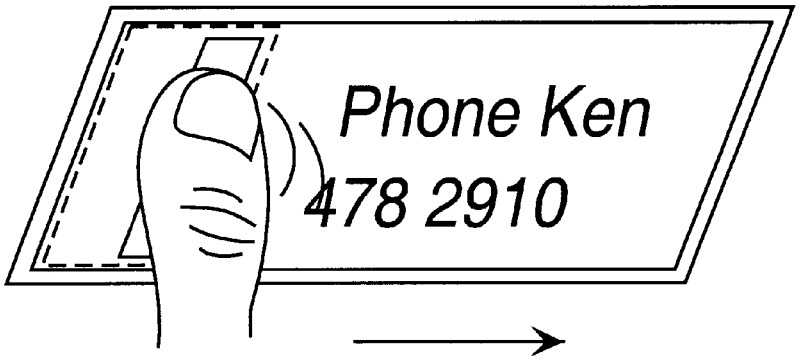
FIGS. 2 and 3 show erasure of the market of FIG. 1.
Figure 3:
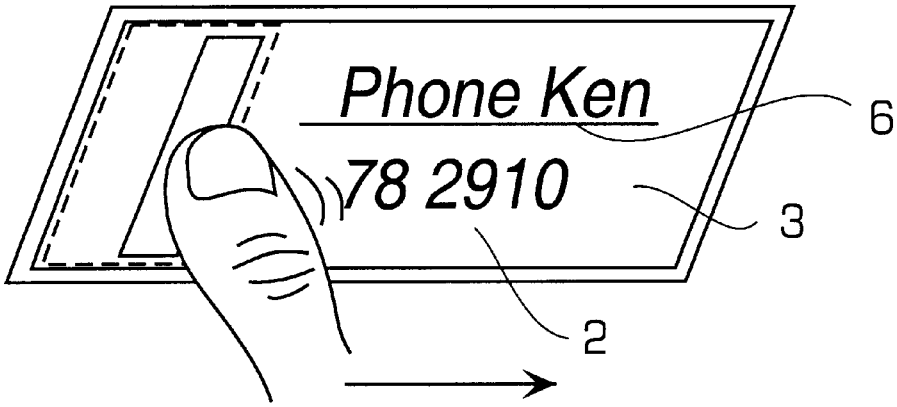
Figure 4:
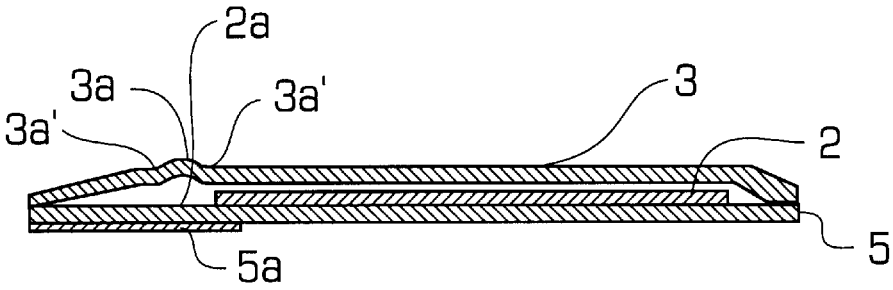
FIG. 4 shows the marker of FIGS. 1, 2 and 3 in cross-section along line I—I of FIG. 1.

Adjacent the base layer 2 is provided a wipe-start region 2*a*. In FIGS. 1 to 3 this wipe-start region 2*a* is indicated by a broken outlines. The wipe-start region may be formed as shown in FIG. 4 by applying no material of the base layer i.e. no waxy or similar material, to the backing sheet 5 beneath the upper sheet 3 in the wipe-start region 2*a*. The region 2*a* may be the same width across the marker as the base layer 2 but could be of less or greater width, and is preferably at least one finger width wide in the direction of erasure along the length of the label, but could be wider, or longer, for larger labels for example.

The upper sheet 3 extends over both the base layer 2 and the erase-start region 2*a* and is fixed to the backing sheet 5 about the periphery of the upper sheet, that is along both sides and at either end of the upper sheet, by gluing, plastic welding or other suitable means during manufacture. Alternative to fixing the upper sheet about the entire periphery upper sheet, the upper sheet may be fixed along at least two opposite sides of the upper sheet or at least most of two opposite sides (in the case of a square or rectangular erasable product bur it is preferred to fix the upper sheet about most of the periphery of the upper sheet, or in less preferred forms about all of the periphery of the upper sheet.

In accordance with the invention a discontinuity is formed in the upper sheet 3, between the part of the upper sheet extending over the wipe-start area 2*a* and the balance of the upper sheet which extends smoothly over the base layer 2 i.e. the message area of the marker in which written details are shown in FIGS. 1 to 3. In the repositionable marker of FIGS. 1 to 3 the discontinuity is a creased region 3*a* or a wrinkle which extends across the marker as shown. One preferred way of forming the discontinuity is to crease two adjacent lines 3*a*, across the upper sheet 3 (across the direction of finger erasure), for example by scribing, punching, or embossing the top sheet to define the long sides of the crease discontinuity 3*a*. Two shorter lines 3*a*" may be similarly formed to define the discontinuity region 2*a* within the region banded by the scribed, embossed, or punched lines 3*a*' and 2*a*". In FIGS. 1 to 4 two adjacent lines 3*a*' across the upper sheet define the crease continuity 3*a*, but in an alternative three or four or more such adjacent or parallel lines may define two or three or more. regions 3*a* forming the discontinuity. Any other means or technique for forming such lines, or forming such a creased or wrinkled discontinuity may be used. It is not necessary that the discontinuity be in the exact form shown. It could be formed as a more V-shaped crease in cross-section for example. The discontinuity need not be rectangularly shaped but could be oval or triangular or hourglass shaped or of any other desired shape, again formed by creasing, scribing lines, embossing, punching or similar.

The arrangement is such that in use a blunt stylus, a pencil or pen (preferably the non-inking/marking end so as not to permanently mark the product) or any hard object such as even a user's fingernail, may be used to write identifying details on the marker by pressing on the upper sheet 3 over the base layer 2. This will cause the upper sheet 3 to adhere to the base layer 2 where localized pressure is applied so that the colour of the base layer is then dearly visible through the translucent upper sheet 3 to display the written details as shown in FIG. 1.

To erase the details from the marker a user's finger or thumb is placed on the wipe-start region 2*a* and wipe across the top surface of the upper sheet 3 from the wipe-start region 2*a* including over the discontinuity or creased region 3*a*. This will separate the upper sheet 3 and the base layer 2 as the user's finger moves. The presence of the discontinuity 3*a* assists in ensuring full and ready erasure of the marker or label. The marker may then be rewritten on as before. As shown in FIG. 3, if a line is drawn between two lines of text, then only one "line" of text may be erased at a time as desired.

Figure 5:
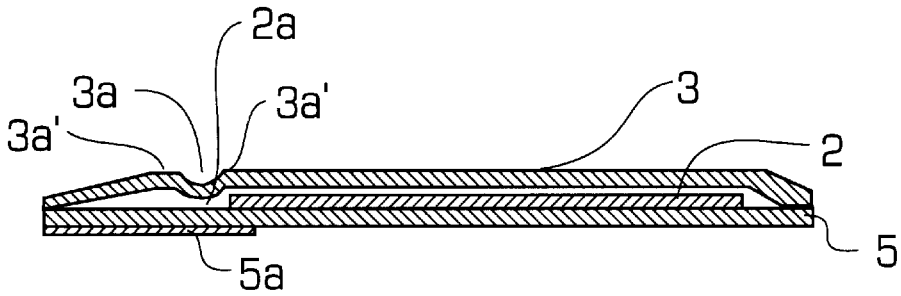
FIG. 5 shows another form of erasable and rewritable marker similar to that of FIGS. 1 to 4, in cross-section.

FIG. 5 shows a repositionable marker very similar to that of FIGS. 1 to 4 except that the discontinuity 3*a* is a downward or reverse crease or wrinkle rather than in upward wrinkle as in FIGS. 1 to 4. The marker of FIG. 5 is used identically to that of FIGS. 1 to 4.

Another form of erasable-rewritable label of the invention (not shown in the drawings) may be very similar to those of FIGS. 1 to 4 and 5, except that instead of the material of the base layer 2 not extending beneath the upper sheet 3 in the wipe-start region 2*a*, to make the upper sheet 3 and base layer 2 nonadhesive together in the wipe-start region, a coating is applied to the under surface of the upper sheet 3 in the wipe-start region 2*a*. The coating is a material such as a silicon or any other suitable coating, which will make the upper sheet nonadhesive to the material of the base layer 2. Another variation is that such a coating is applied to the top surface of the base layer 2 in the wipe-start region 2*a*, instead of applying the coating to the undersurface of the upper sheet 3. This has the same effect, of making the upper sheet 3 and base layer 2 nonadhesive together in the wipe-start region 2*a*.

Both of the repositionable markers of FIGS. 1 to 4 and FIG. 5, have a restrictable contact adhesive 5*a* applied to a part of the undersurface of the backing sheet 5 as referred to previously, so that the markers can bee stuck on to a face, and subsequently removed and repositioned. The markers may therefore be used the same way as POST-IT notes as message or reminder labels or notes or similar. The invention is not limited to such repositionable labels or markers however, and may alternatively be applied to more permanent or semipermanent labels in which the whole of the undersurface of the backing sheet 5 is coated with an adhesive, and also to erasable products which are formed permanently to the surface of an object such as the spine of a folder or video cassette for example.

FIGS. 6 to 9 show a repositionable erasable sign. Again the erasable sign comprises a base layer 2 on a backing sheet 5, and an upper sheet 3, which are very similar to the base layer 2 and upper sheet 3 of the label of FIGS. 1 to 4 and may be formed of similar materials. The backing sheet 5 has a restrictable adhesive 5*a* on a part of its rear surface to enable the sign to be stuck to a surface and subsequently removed and repositioned. The upper sheet 3 is preferably translucent and may comprise a translucent plastic film. The sign has a similar wipe-start area 2*a* beneath a part of the upper sheet 3 as before.

Rather than cover all of the area beneath the upper sheet 3 other than the wipe-start region 2*a*, the base layer consisting of a layer of wax or similar is formed in the shape of an icon or indicia such as the tick shown in the drawings. The icon or indicia instead of being the tick shown could be any other letter, word, number, symbol or the like. The icon or indicia may be made to have a contrasting colour, for example, by incorporating a dye in the base layer.

The erasable sign incorporates a similar discontinuity 3*a* to that of FIGS. 1 to 4 or 5, which again may be formed as a creased region or wrinkle as described previously.

Figure 7:
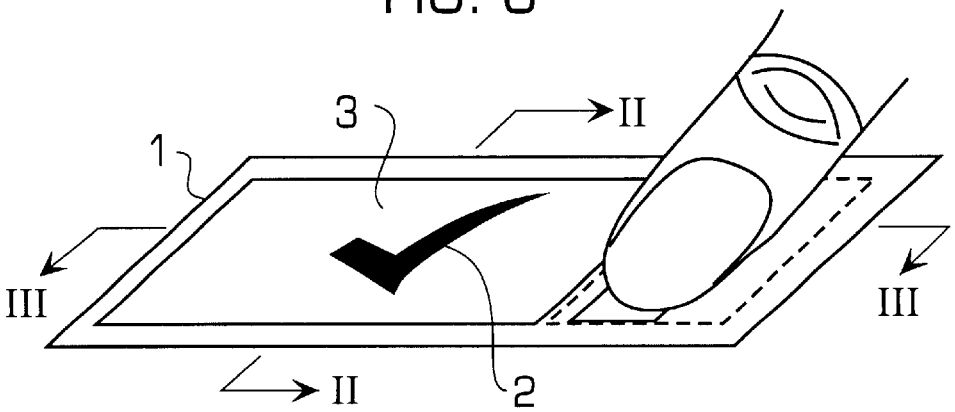
FIG. 7 shows the sign of FIG. 6 with the icon on indicia visible and showing erasure of the icon or indicia.
Figure 8:
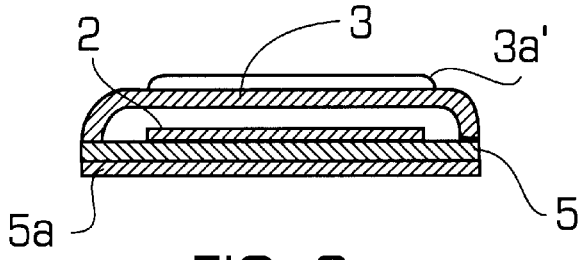
FIG. 8 shows the erasable sign of FIGS. 6 and 7 in cross-section along line II—II of FIG. 7.
Figure 9:
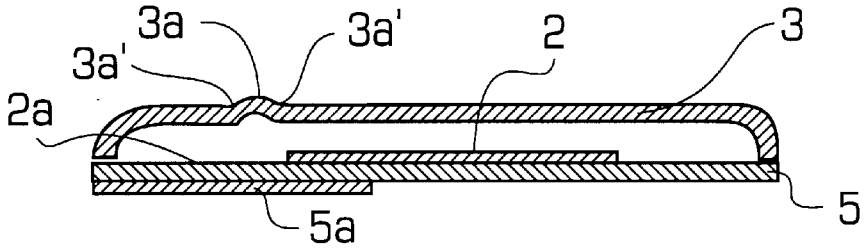
FIG. 9 shows the erasable sign of FIGS. 6 and 7 in cross-secfion along line III—III of FIG. 7.

In use the upper sheet 3 is pressed down, for example by pressing and repeatedly running a fingernail or stylus over the upper sheet 3 to block or scribble in the required area. This will cause the upper sheet 3 to adhere to the base layer icon or indicia 2 so that the icon or indicia is then clearly visible through the translucent upper sheet 3, as shown in FIG. 7.

Figure 6:
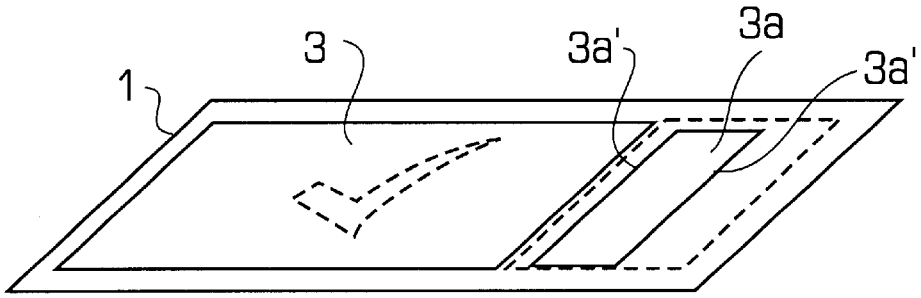
FIG. 6 shows one preferred form of repositionable erasable sign, showing in FIG. 6 an icon or indicia of the sign not visible.

To erase the icon or indicia so that it is no longer visible, a user's finger of thumb is wiped across the top surface of the upper sheet 3 from the wipe-start area 2*a* over the discontinuity 3*a* and across the rest of the surface of the upper sheet 3 in the same way as to erase written information from the repositionable markets of FIGS. 1 to 4 and 5, This will separate the upper sheet 3 from the base layer 2, making the icon or indicia substantially invisible. In FIG. 6 the tick is shown in phantom outline for illustrative purposes only.

Instead of the base layer 2 being formed in the shape of the desired icon or indicia as shown in FIGS. 6 to 9, the icon or indicia may be ink printed beneath the base layer and the base layer may then comprise a coating of clear or near clear wax or similar over the whole of the backing sheet, except the wipe-start region 2*a*. When the upper sheet is pressed against the base layer the upper sheet will adhere to the base layer and the ink printed icon or indicia behind the base layer will become visible through the upper sheet. The sign is erased as before.

To assist in making the icon or indicia less visible when the upper sheet 3 is not Adhered to the base layer 2 colour of the icon or indicia may be made only medium contrast rather than high contrast, and also the top side or under side of the upper sheet 3 may have printed onto it a pattern of small dots or wavy lines or similar which will tend to hide any shadowy image of the icon or indicia that may still be visible through the upper sheet. Such a pattern of dots or wavy lines or similar should not be sufficiently dense or large to obscure the icon when the upper sheet is pressed to adhere to the base layer 2 to make the icon visible. Such a pattern of dots or wavy lines or similar may be printed with a translucent ink, or even with an opaque ink where the pattern is not too dense.

Figure 10:
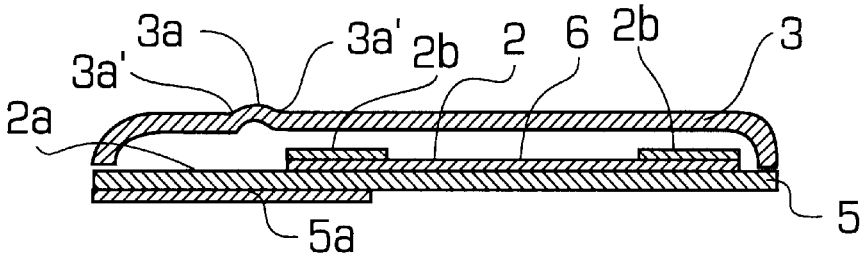
FIG. 10 shows another preferred form of repositionable erasable sign similar to that of FIGS. 6 to 9 in cross-section.

FIG. 10 shows a form of erasable sign similar to that of FIGS. 6 to 9 in that an icon or indicia is visible when the upper sheet 3 is pressed down for example by pressing and repeatedly running a fingernail or stylus over the upper sheet 3 to block or scribble in the required area, and is erased so as to be no longer visible when a user's finger or thumb is wiped across the top surface of the upper sheet 3 form the wipe-start area 2*a*. However, in the erasable product of FIG. 10 the coloured base layer 2 is continuous (other than the wipe-start region 2*a*) and a coating 2*b* is applied over the top of the base layer 2 except in a region defining the shape of the icon 2, i.e., the coating is applied as a negative image of the icon on top of the base layer 2 (but the coating 2*b* could also be applied as a positive image). When the upper sheet 3 is pressed down by running an object over the upper sheet 3 the upper sheet 3 will adhere to the base layer where the coating 2*b* is not applied but will not adhere to the coating 2*b* so that the icon or indicia will be visible through the upper sheet. To erase the icon or indicia so that it is no longer visible a user's finger or thumb is wiped across the top surface of the upper sheet 3 as before.

FIGS. 11 to 14 show another preferred form of repositionable, erasable sign. Again, the sign comprises a base layer 2 of wax or similar carried by a backing sheet 5 having a restrictable contact adhesive on part of its rear surface 5*a*, and an upper sheet 3. In this form an icon or indicia is printed on the upper sheet 3, which is shown in the drawings as a tick printed on the underside of the upper sheet 3 as a positive image, see FIG. 14 at 6. Alternatively the area around the icon on indicia such as the tick may be printed so that the icon or indicia appears as a negative image, i.e. the icon or indicia itself remains as the translucent material with the icon or indicia possibly being given a tint of for example yellow or orange by printing (without loss of the translucent quality). The icon or indicia may be printed on the top side or underside of the upper sheet 3. Again the erasable sign incorporates a similar discontinuity 3*a* as previously described.

Figure 11:
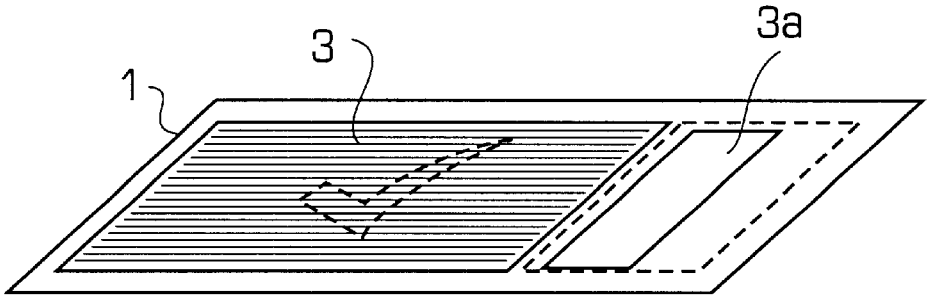
FIG. 11 shows another preferred form of repositionable erasable sign with the icon or indicia of the sign not visible.

To cause the icon or indicia such as the tick to disappear, the upper sheet 3 is pressed against the backing sheet, for example by pressing and repeatedly running a fingernail or suitable stylus over the upper sheet to block or scribble in the required area. This will cause the upper sheet 3 to adhere to the base layer 2 and the icon or indicia will then merge into the colour of the base layer where the icon or indicia has been printed as a positive image, or the colour of the base layer will become visible through the icon or indicia when printed as a negative (translucent) image so that the entire area about the icon or indicia will be blocked out, in a dark colour if the base layer is also a dark colour for example, as shown in FIG. 11. In FIG. 11 the icon or indicia which is a tick is shown in phantom outline for explanatory purposes.

Figure 12:
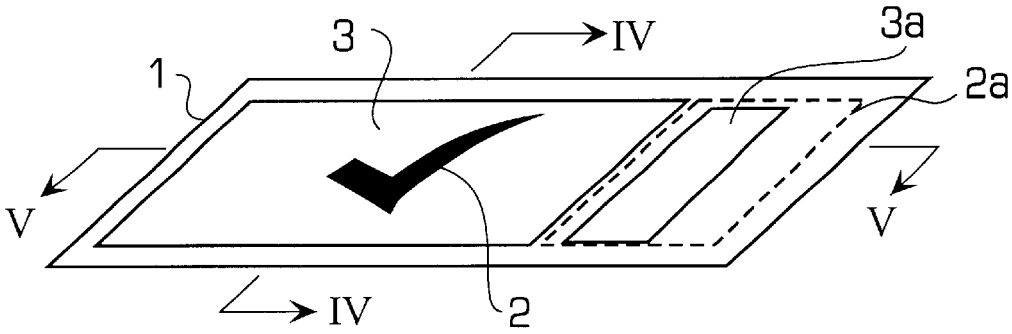
FIG. 12 shows the erasable sign of FIG. 11 with the icon or indicia visible.
Figure 13:
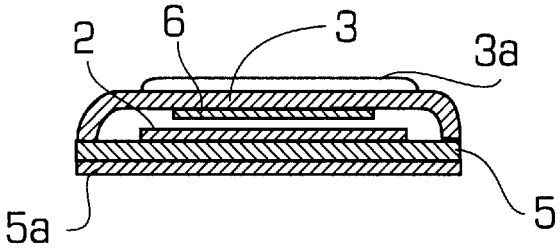
FIG. 13 shows the erasable sign of FIGS. 11 and 12 in cross-section along line IV—IV of FIG. 12.
Figure 14:
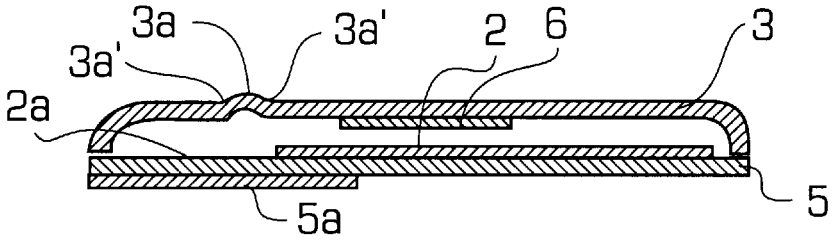
FIG. 14 shows the erasable sign of FIGS. 11 and 12 in cross-section along line V—V of FIG. 12.

To cause the icon or indicia to appear, a user's finger or thumb is wiped across the sign from the wipe-start area 2*a*, across the creased region or similar 3*a*, and on the same way as previously described. This will separate the upper sheet 3 and the base layer 2 as the user's finger moves, so that the icon or indicia will again become visible, as shown in FIG. 12.

Figure 15:
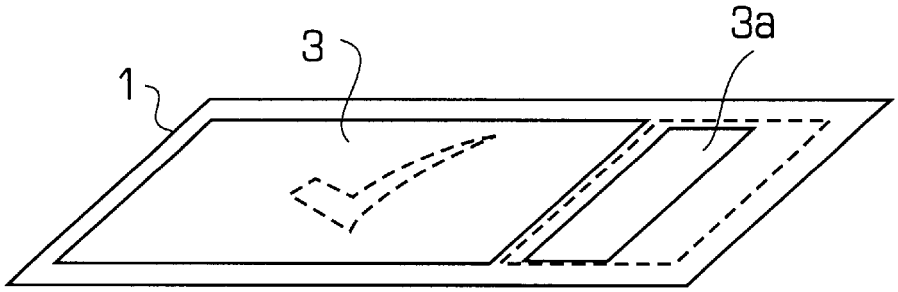
FIG. 15 shows another preferred form of repositionable erasable sign with the icon or indicia not visible.
Figure 16:
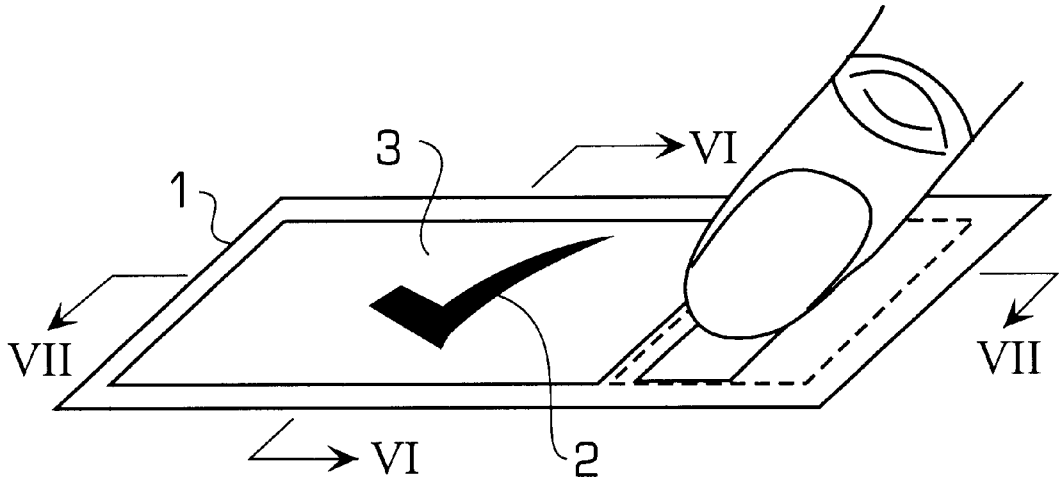
FIG. 16 shows the erasable sign of FIG. 14 with the icon or indicia visible and showing the start of wipe action to make the icon or indicia of the sign nor, visible.
Figure 17:
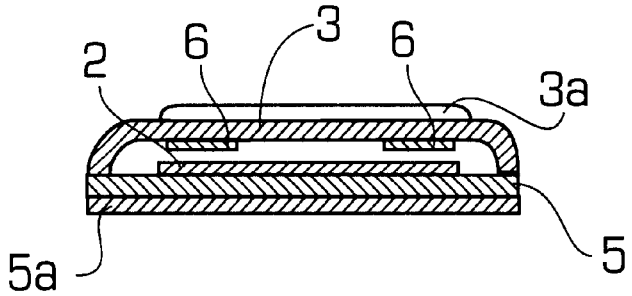
FIG. 17 shows the erasable sign of FIGS. 15 and 16 in cross-section along line VI—VI of FIG. 16.
Figure 18:
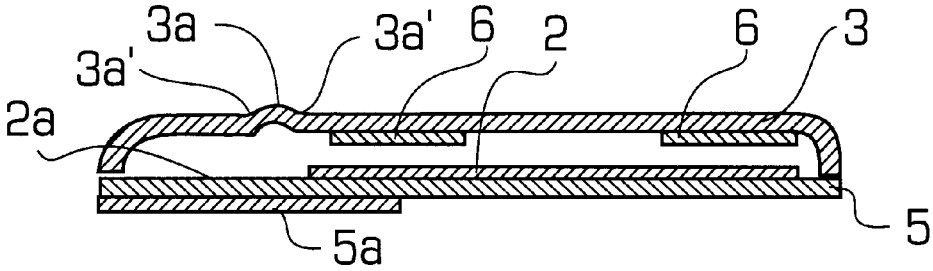
FIG. 18 shows the erasable sign of FIGS. 15 and 16 in cross-section along line VII—VII of FIG. 16.

FIGS. 15 to 18 show yet another preferred form of repositionable erasable sign. Again, the sign comprises a base layer 2 of wax or similar carried by a backing sheet 5 with a part adhesive rear surface 5*a*, and an upper sheet 3. The upper sheet incorporates a discontinuity 3*a* as previously described. In this form an icon or indicia is printed as a negative image on the upper sheet 3, preferably on the under side of the upper sheet 3. An icon or indicia is shown in the drawings as a tick printed on the under side of the upper sheet 3 as a negative image see FIGS. 17 and 18. To cause the icon or indicia to appear, the upper sheet 3 is pressed against the backing sheet, for example, by pressing and repeatedly running a fingernail or suitable stylus over the upper sheet. This will cause the upper sheet 3 to adhere to the base layer 2 so that the colour of the base layer will appear through the upper sheet 3 where it is not printed with the layer 6, to form the icon or indicia, as shown in FIG. 16. To cause the icon or indicia to disappear, a user's finger or thumb is wiped across the sip including across the discontinuity 3*a* in the same way as previously described, from the wipe-start region 2*a*. This will separate the upper sheet 3 and the base layer 2 as the user's finger moves, so that the icon or indicia will become invisible, as shown in FIG. 15. Preferably the image 6 is printed with a colour which is only a medium contrast with the colour of the base layer 2, such as a lighter grey if the base layer is a dark grey or a lighter red if the base layer is a darker red, to assist in making the icon more invisible when erased. Also as mentioned previously, a pattern which will tend to obscure the icon image i,e. the colour of the base layer through the upper sheet 3 when the icon has been erased, may be printed on to the upper sheet 3, for example an to the top surface, such as a pattern of dots or wavy lines or similar.

Erasable products of the invention are preferably formed as a sealed unit thereby preventing the ingress of contaminants and improving mechanical robustness and structural integrity of the label. However, small air vents may be provided in the form of one or more slits and/or pinholes near the periphery of product such as at either end for example, which can assist in easy erasure of the product, and also as mentioned the upper sheet does not necessarily need to be fixed to the base layer about the entire periphery of the base layer so long as it fixed along at least most of two opposite sides. The wiping action employed in use assists in redistributing the wax or other material of the base layer into any cavities formed by localised pressure during writing thus extending the life the erasable product.

Preferably in manufacture of repositionable erasable products of the invention in particular, the upper sheet 3 is applied to the base layer without any slackness in the material forming the upper sheet relative to the base layer 2 backing sheet 5 (except for any "slackness" in the discontinuity 3*a*). It may even be desirable to subject the upper sheet 3 to a slight tension relative to the backing sheet 3 while laying the upper sheet 3 down onto the backing sheet 5. In the case of reposifionable products this assists in preventing accidental erasure of the product as it is handled or if it is bowed or bent during handling or in use generally, but provision of a discontinuity in the upper sheet according to this invention assists in overcoming any difficulties in erasure which such upper sheet tension would otherwise tend to create. This is in contrast to erasable products of the invention which are not intended to be repositionable, in which it is desirable to have little or minimal tension in the upper sheet.

The foregoing describes the erasable product of the invention and preferred forms thereof. Alterations and modifications and combinations of features not specifically described as will be obvious to those skilled in the art are intended to be incorporated within the scope hereof.

What is claimed is:

1. An erasable product comprising a base layer and an upper sheet extending over the base layer and the upper sheet having peripheral sides fixed in relation to the base layer, which upper sheet and base layer are in a first area sufficiently releasably adhesive together under pressure applied manually on the upper sheet to cause the upper sheet and the base layer to adhere in the localized region of said pressure but to allow the upper sheet to move sufficiently relative to the base layer to separate the upper sheet from the base layer when a user's finger or thumb is wiped across the top surface of the upper sheet, the upper sheet also extending in a second area over a wipe-start region adjacent the base layer in which the wipe-start region, the upper sheet, and the base layer are not adhesive together and over which wipe-start region a user's finger or thumb may be placed from which to begin said movement to separate the upper sheet from the base layer, the upper sheet also comprising a discontinuity in the upper sheet extending across at least a major portion of one dimension of the upper sheet in the plane of the upper sheet and having a generally convex shape in cross-section, said discontinuity in the upper sheet occupying a smaller area of the upper sheet than the wipe-start region and said discontinuity extending either across the wipe-start region adjacent said first area so that said discontinuity separates said first area and a part of the wipe-start region larger in area than said discontinuity, or in said first area adjacent said wipe-start region so that said discontinuity separates said first area and said wipe-start region, said upper sheet also providing a smooth and otherwise substantially wrinkle-free top surface to the product on either side of said discontinuity in said first area and said second area.

2. An erasable product according to claim 1, which is a repositionable erasable product having a restickable adhesive on a part of the rear surface of the erasable product enabling the erasable product to be adhered to a surface and subsequently removed and re-adhered to a surface.

3. An erasable product according to claim 1, wherein the erasable product is a repositionable marker or label or message note.

4. An erasable product according to claim 1, wherein material comprising the base layer is not provided beneath the upper sheet in said wipe-staet region to form the wipe-start region in which the upper sheet and base layer are not adhesive together.

5. An erasable product according to claim 1, wherein the base layer extends beneath the upper sheet in said wipe-start region and a release coating is applied to the under surface of the upper sheet or to the top surface of the base layer in the wipe-start region to form the wipe-start region in which the upper sheet and base layer are not adhesive together.

6. An erasable product according to claim 1, comprising a contrasting icon or indicia in or below the base layer which icon or indicia is visible through the upper sheet when pressure is applied manually on the upper sheet to cause the upper sheet and the base layer to adhere and which is made substantially less visible when a user's finger or thumb is wiped across the top surface of the upper sheet from said wipe-start region adjacent the base layer to separate the upper sheet from the base layer.

7. An erasable product according to claim 1, comprising an icon or indicia printed on the upper sheet in a color such that when pressure is applied manually on the upper sheet to cause the upper sheet and the base layer to adhere said icon or indicia is made substantially less visible and when a user's finger or thumb is wiped across the top surface of the upper sheet from said wipe-start region adjacent the base layer to separate from the base layer said icon or indicia becomes visible.

8. An erasable product according to claim 1, wherein the base layer and upper sheet over the base layer are longer than they are wide, and said wipe-start region adjacent the base layer to which material comprising the base layer is not applied is provided at one end of the base layer.

9. An erasable product according to claim 8, wherein the width of the base layer and upper sheet are such that the full width of the upper sheet may be separated from the base layer by a single pass of a user's finger or thumb over the upper sheet.

10. An erasable product according to claim 1, wherein the discontinuity is formed by punching or embossing the upper sheet to form the discontinuity or by creasing or scribing lines in the upper sheet to define the discontinuity.

* * * * *